US005785227A

United States Patent [19]

Akiba

[11] Patent Number: 5,785,227

[45] Date of Patent: Jul. 28, 1998

[54] ADJUSTMENT MECHANISM FOR ADJUSTING DEPTH AT WHICH PNEUMATIC NAILING MACHINE DRIVES NAILS INTO WORKPIECE

[75] Inventor: Yoshitaka Akiba, Hitachinaka, Japan

[73] Assignee: Hitachi Koki Co., Ltd., Tokyo, Japan

[21] Appl. No.: 740,953

[22] Filed: Nov. 5, 1996

[30] Foreign Application Priority Data

Nov. 10, 1995 [JP] Japan ..... 7-291585

[51] Int. Cl.[6] ..... B25C 1/04

[52] U.S. Cl. ..... 227/8; 227/142

[58] Field of Search ..... 227/8, 130, 142

[56] References Cited

U.S. PATENT DOCUMENTS

| | | | |
|---|---|---|---|
| 4,838,471 | 6/1989 | Chiesa | 227/142 |
| 5,219,110 | 6/1993 | Mukoyama | 227/8 |
| 5,263,842 | 11/1993 | Fealey | 227/8 |
| 5,385,286 | 1/1995 | Johnson, Jr. | 227/8 |
| 5,593,079 | 1/1997 | Mukoyama et al. | 227/142 |
| 5,667,127 | 9/1997 | Ichikawa et al. | 227/142 |

FOREIGN PATENT DOCUMENTS

| | | | |
|---|---|---|---|
| 1 603 827 | 1/1972 | Germany | B25C 1/04 |
| 40 32 231 | 6/1991 | Germany | B25C 1/04 |
| 44 33 746 | 3/1995 | Germany | B25C 1/00 |

*Primary Examiner*—Scott A. Smith

*Attorney, Agent, or Firm*—Sughrue, Mion, Zinn, Macpeak & Seas, PLLC

[57] ABSTRACT

A pneumatic nailing machine having a driving depth adjusting mechanism disposed near a trigger. A push lever is vertically movably supported around a nose portion and extends near the trigger. The push lever is divided into an upper section and a lower section, the dividing portion being near the trigger. A cam shaft having first and second cam lobes are rotatably provided near the trigger. A lowermost end of the upper section is in slide contact with the first cam lobe, and an uppermost end of the lower section is in slide contact with the second cam lobe. The cam shaft together with the cam lobes, and the upper and lower sections are concurrently movably supported by a guide plate supported by a main body. By rotating the cam shaft in one direction, a distance between the lowermost and uppermost ends is increased to expand entire length of the push lever.

15 Claims, 7 Drawing Sheets

ADJUSTMENT MECHANISM FOR ADJUSTING DEPTH AT WHICH PNEUMATIC NAILING MACHINE DRIVES NAILS INTO WORKPIECE

BACKGROUND OF THE INVENTION

The present invention relates to a pneumatic nailing machine having a mechanism for regulating a driving depth of nails or other fasteners into a workpiece.

It is desirable that the driving depth at which a pneumatic nailing machine drives nails into a workpiece be adjustable. When nails are driven into the workpiece too deeply, the surface of the workpiece around the nail head may be indented by the nail head, resulting in a pitted and uneven workpiece surface. On the other hand, if the driving depth is insufficient, the nail head is projected or separated from the top surface of the workpiece.

A conventional pneumatic nailing machine having the driving depth adjusting mechanism is shown in FIGS. 1 through 3. As shown in FIG. 1, the conventional pneumatic nailing machine has a main body 101 with a nose portion 108. A piston is slidably movably disposed in the main body 101, and a drive bit 107 is connected to the piston. The drive bit 107 can extends into the nose 108 which defines an injection passage 103 for a fastener 104. A nail magazine 135 is connected to the nose 108, so that the fasteners 104 in the magazine 135 can be successively fed into the injection passage 103.

A trigger 102 is pivotally movably provided to the body 101, and a trigger plate 102A is pivotally movably provided to the trigger 102. A trigger valve 132 is provided for providing a pneumatic force to the piston, and a plunger 134 is provided to actuate the trigger valve 132. If the trigger plate 102A is pivotally moved to a pivot position, the trigger plate 102A can be abuttable on the plunger 134, so that the trigger valve 132 is actuated upon manipulation to the trigger 102. On the other hand, if the trigger plate 102A is in a rest position, the trigger plate 102A does not abut the plunger 134 even by the manipulation to the trigger 102. The pivotal movement of the trigger plate 102A is provided by a vertical movement of a push lever 105.

The push lever 105 is provided attached to the nose 108 of the body 101. A lower end portion of the push lever 105 is positioned adjacent an injection opening of the injection passage 103, and an upper end portion of the push lever 105 is positioned adjacent the trigger 102. The push lever 105 is movable in an axial direction of the drive bit 107. A compression spring 106 is interposed between the main body 101 and the push lever 105 for urging the push lever 105 toward the injection opening, i.e., a tip end of the nose 108.

With this arrangement, when a lowermost end **105*a* of the push lever 105 is pressed against a workpiece 111 so as to lift the push lever 105 against the biasing force of the compression spring 106, and if the trigger 102 is pulled, the drive bit 107 is immediately moved downwardly, so that the fastener 104 fed in the injection passage 103 is driven by the drive bit 107 into the workpiece 111. This fastening operation can also be performed by pressing the push lever 105 against the workpiece 111 while maintaining pulling state of the trigger 102**.

The main body 101 integrally provides an upper stop piece **101*a* and a lower stop piece 101*b*. Further, the push lever 105 has an upper section 105*e* and a lower section 105*f*. The upper section 105*e* has an uppermost end portion 105*b* abuttable on the trigger plate 102A, an upper abutting portion 105*c* abuttable on the upper stop piece 101*a*, and a lower abutting portion 105*d* abuttable on the lower stop piece 101*b*. The lower section 105*f* has the lowermost end 105*a***.

A geometrical positional relationship between a position of the uppermost end **105*b* of the push lever 105 and the angular position of the trigger 102 will determine driving or non-driving of the drive bit 107. That is, if the push lever 105 is pressed against the workpiece 111 until the upper abutting portion 105*c* is brought into abutment with the upper stop piece 101*a*, the uppermost end portion 105*b* of the push lever 105 moves up the trigger plate 102A. In this case, if the trigger 102 is pulled, the trigger valve 132 can be actuated to move down the drive bit 107. On the other hand, if the push lever 105 is at its descent position because of the biasing force of the compression spring 106, the lower abutting portion 105*d* abuts the lower stop member 101*b*, and therefore, the uppermost end portion 105*b* of the push lever 105 does not rise up the trigger plate 102A. Accordingly, even if the trigger 102 is pressed, the trigger valve 132** can not be actuated.

As shown in FIG. 3, the driving depth is determined by a distance "A" between the lowermost end **105*a* of the push lever 105 and a tip end 107*a* of the drive bit 107. By adjusting the position of the lowermost end 105*a* of the push lever 105, the distance "A" can be changed to change the driving depth. To this effect, an entire length of the push lever 105 from the uppermost end 105*b* of the upper section 105*e* to the lowermost end 105*a* of the lower section 105*f* is controllable. More specifically, an adjusting mechanism including a screw 139 and a knob 140 is provided between the upper and lower sections 105*e* and 105*f* to connect these at a position adjacent the injection passage 103. By manually rotating the knob 140 by several times, the screw 139 is rotated about its axis, so that the threading engagement between the upper and lower sections 105*e* and 105*f* changes the entire length of the push lever 105**, thereby changing the distance A.

However, in the driving depth adjustment work, the knob 140 must be rotated by several times, which is troublesome for an operator. Further, because the adjusting mechanism is positioned beside the nose portion 108 and is laterally protruded as shown in FIG. 2, the adjusting mechanism may abut or contact the workpiece 111 or ambient construction during driving work. In other words, the adjusting mechanism may be an obstacle for a desirable nail driving operation. Furthermore, if the pneumatic nailing machine is rested on the workpiece 111 during non-use period, the protruding adjustment mechanism may damage to the surface of the workpiece 111.

In order to overcome the above described drawbacks, another proposal has been made as shown in FIG. 4 in which a connecting portion between upper and lower sections **205*e* and 205*f* of a push lever 205 is located adjacent a trigger 102. That is, a driving depth adjusting mechanism including a screw 239 and a knob 240 is positioned nearby the trigger 102. With this arrangement, however, the adjusting mechanism is in an extremely narrow space, i.e., below the trigger 102, above the magazine 135, and beside the main body 101, and the operator must access and rotate the knob 240** by several times. Accordingly, operability to the adjusting mechanism may be degraded.

Furthermore, Japanese Utility Model Application Kokai No. Hei 3-52083 discloses a nail gun having a driving depth adjusting mechanism in which a single cam is used for expanding and shrinking an entire length of the push lever.

However, large size cam is required in order to obtain sufficient expansion and shrinkage of the push lever. Then, it would be almost impossible to install the large cam at the narrow space around the trigger.

Furthermore, for reference only, commonly assigned U.S. patent application Ser. No. 08/399,466 is filed on Mar. 7, 1995.

SUMMARY OF THE INVENTION

It is therefore an object of the present invention to provide an improved pneumatic nailing machine having a driving depth adjustment mechanism which can be positioned around or adjacent the trigger yet can facilitate operability for operating the adjustment mechanism.

Another object of the present invention to provide the adjustment mechanism capable of performing sufficient driving operation without damaging to the workpiece during driving operation and non-driving operation.

These and other objects of the present invention will be attained by a pneumatic nailing machine for driving a nail into a workpiece, the pneumatic nailing machine including a main body, a nose, a trigger, a push lever, a drive bit and an improved nail driving depth adjusting mechanism. The nose is provided to the main body and the nail is protrudable from the nose. The trigger is pivotally supported to the main body for starting a nail driving operation. The push lever is vertically movably supported to the main body. The push lever has a lower tip portion positioned near the nose and an upper tip portion positioned near the trigger. The push lever is divided into an upper section having a lowermost end and a lower section having an uppermost end. The drive bit is supported in the main body and is movable in an axial direction thereof. The drive bit is moved along the nose upon manipulation of the trigger. The nail driving depth adjusting mechanism is adapted for controlling a distance between a lower tip end of the nose and a lower tip end of the push lever when the push lever is pressed against the workpiece. The nail driving depth adjusting mechanism includes a shaft portion, a knob portion, and first and second cam lobes. The shaft portion is rotatable about its axis and is positioned adjacent the trigger. The knob portion is connected to the shaft portion for rotating the shaft portion about its axis. The first cam lobe is provided to the shaft portion and having a first cam surface engageable with the lowermost end of the upper section of the push lever. The second cam lobe is provided to the shaft portion and having a second cam surface engageable with the uppermost end of the lower section of the push lever. Contour of the first and second cam surfaces are arranged to simultaneously move the lowermost end and the uppermost end away from each other in accordance with a rotation of the knob in one direction and to simultaneously move the lowermost end and the uppermost end toward each other in accordance with the rotation of the knob in an opposite direction.

BRIEF DESCRIPTION OF THE DRAWINGS

In the drawings:

FIG. 10(*b*) is a view for description of a distance between the upper and lower sections in accordance with rotation of these cam lobes according to the first embodiment;

FIG. 10(*c*) is a view for description of the second largest distance in the first embodiment;

FIG. 11(*b*) is a partial cross-sectional view showing the tip end portions after the cam lobes are rotated by "SX" from the state shown in FIG. 11(*a*) in the first embodiment; and, FIG. 12 is a cross-sectional view showing an essential portion of a driving depth adjusting mechanism according to a second embodiment of the present invention and corresponding to FIG. 6.

DETAILED DESCRIPTION OF THE PREFERRED EMBODIMENTS

A pneumatic nailing machine having a depth adjustment mechanism according to a first embodiment of the present invention will be described with reference to FIGS. 5 through 11(*b*).

Figure 1:
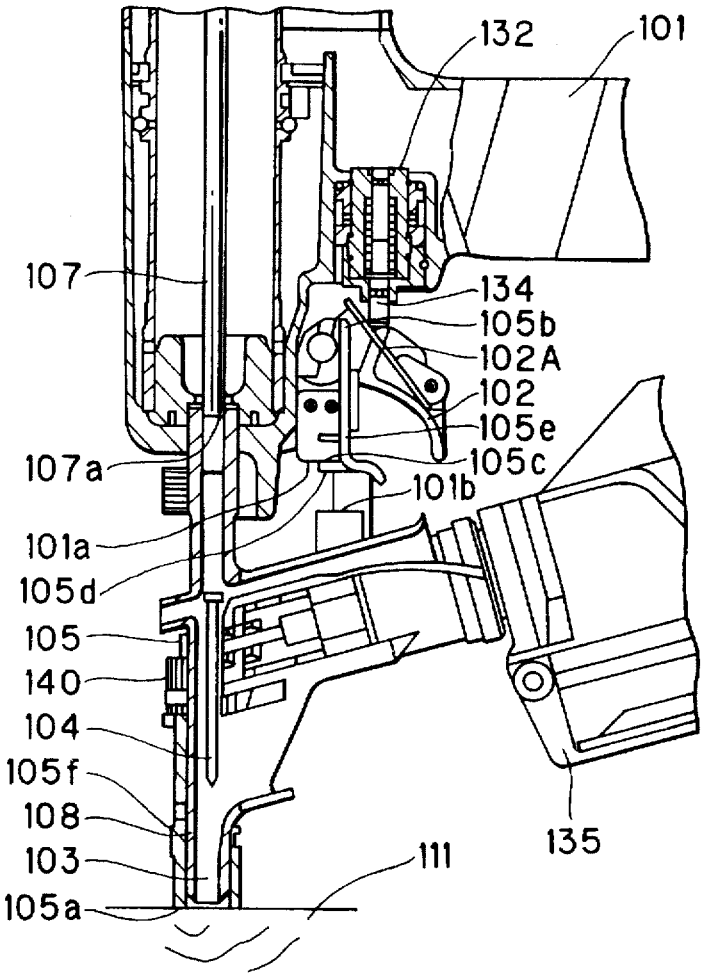
FIG. 1 PRIOR ART
FIG. 1 is a cross-sectional view showing a conventional pneumatic nailing machine having a driving depth adjusting mechanism.
Figure 2:
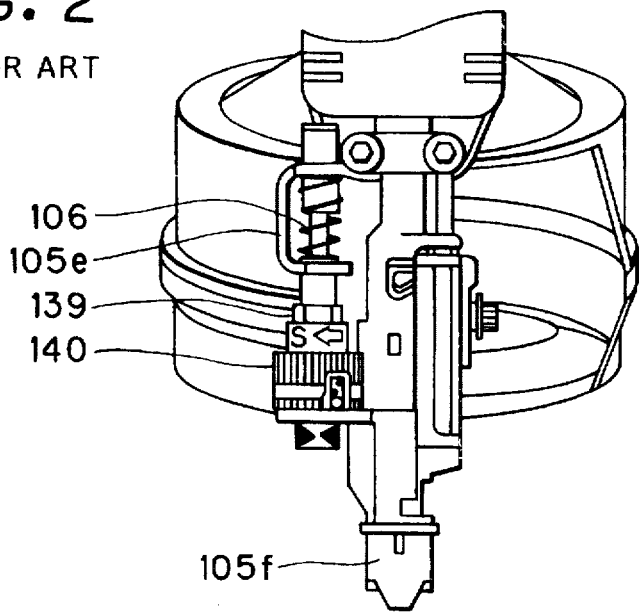
FIG. 2 PRIOR ART
FIG. 2 is a schematic view showing a part of the driving depth adjusting mechanism in the conventional nailing machine.
Figure 3:
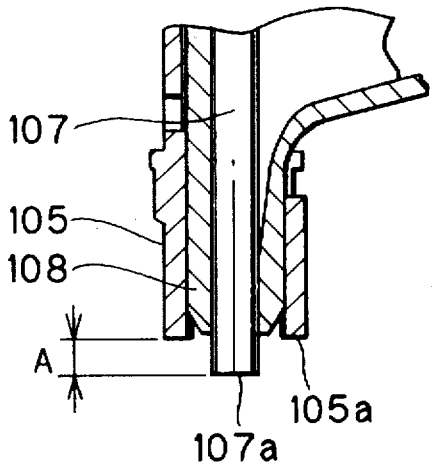
FIG. 3 PRIOR ART
FIG. 3 is a cross-sectional view for description of a driving depth.
Figure 4:
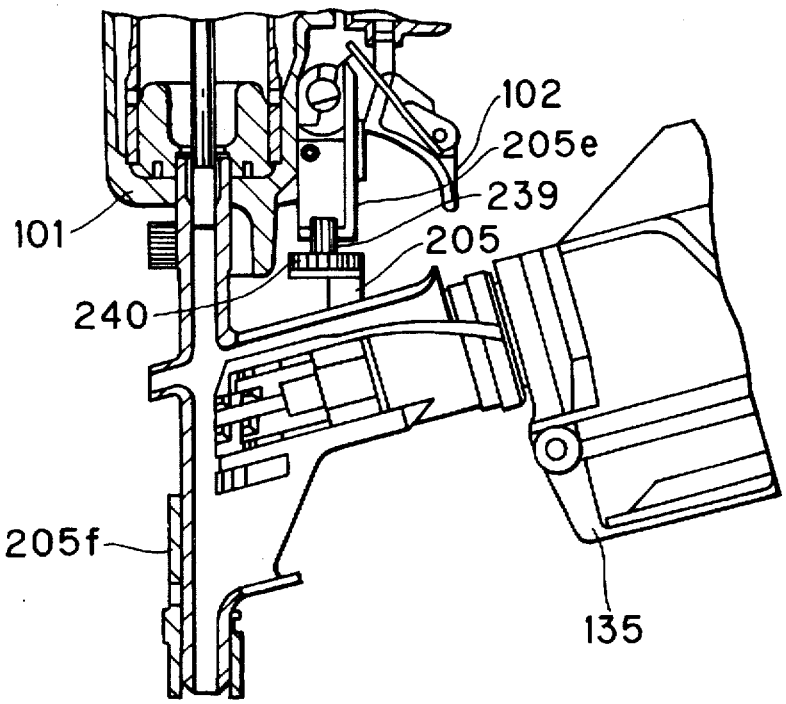
FIG. 4 PRIOR ART
FIG. 4 is a cross-sectional view showing a conventional pneumatic nailing machine having an another type of a depth adjusting mechanism.
Figure 5:
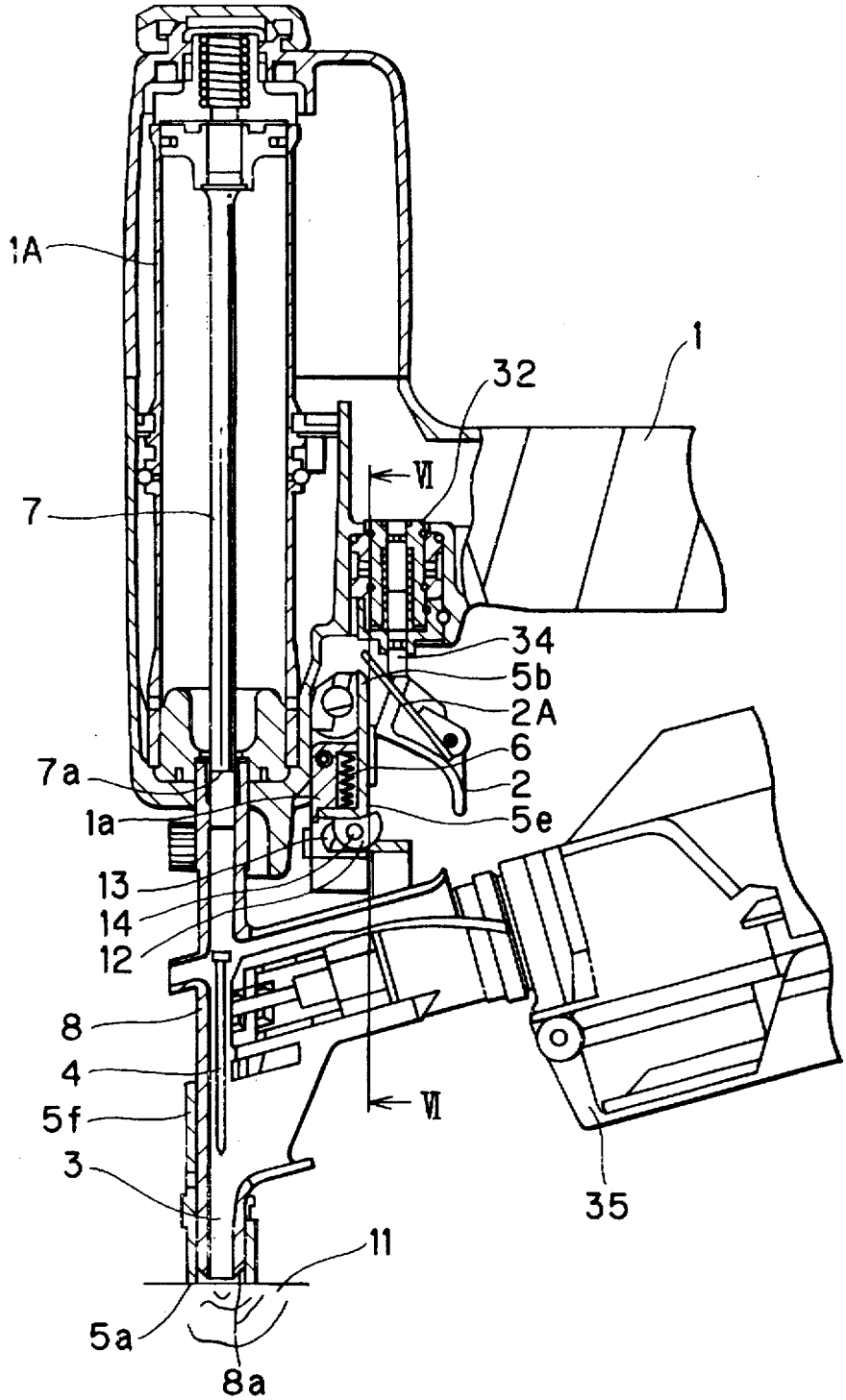
FIG. 5 is a cross-sectional view showing a pneumatic nailing machine having a driving depth adjusting mechanism according to a first embodiment of the present invention.

As best shown in FIG. 5, the pneumatic nailing machine includes a body 1 provided with an internal cylinder 1A. A piston to which is fixed a drive bit 7 is slidingly engaged in the cylinder 1A. A nose 8 for guiding vertical movement of the drive bit 7 is formed at the tip of the body 1. A tip end 7*a* of the drive bit 7 is provided reciprocally movable through the nose 8. A magazine 35 for housing nails is supported by the body 1. Nails 4 in the magazine 35 are sequentially fed to an injection passage 3 formed in the nose 8. Further, similar to the conventional nailing machine, there are provided a trigger 2, a trigger plate 2A, a plunger 34 and a trigger valve 32.

A push lever 5 is slidably movably supported around the nose portion 8 and extends between a position adjacent the trigger 2 and a position near an injection opening 8*a* of the nose 8 similar to the conventional arrangement. The push lever 5 is divided into two sections, i.e., an upper section 5*e* and a lower section 5*f*. A connecting portion between the upper and lower sections 5*e* and 5*f* is located near the trigger 2.

At a position between the upper and lower sections 5*e* and 5*f*, a cam shaft 14 is provided rotatable about its axis. The cam shaft 14 integrally provides a first cam lobe 12 and a second cam lobe 13 having a configuration identical with each other and spaced away from each other in the axial direction of the cam shaft 14. The first and second cam lobes 12 and 13 are arranged in a rotation-symmetric fashion in which a symmetry center is at the axis of the cam shaft 14, and the two cam lobes 12 and 13 are provided at an angular displacement of 180 degrees with respect to the axis and, so that rotating the cam shaft 14 by 180 degrees around the symmetry center can align one of the cam lobes in the same direction as the other cam lobe. The first and second cam lobes 12, 13 are provided integrally.

Figure 6:
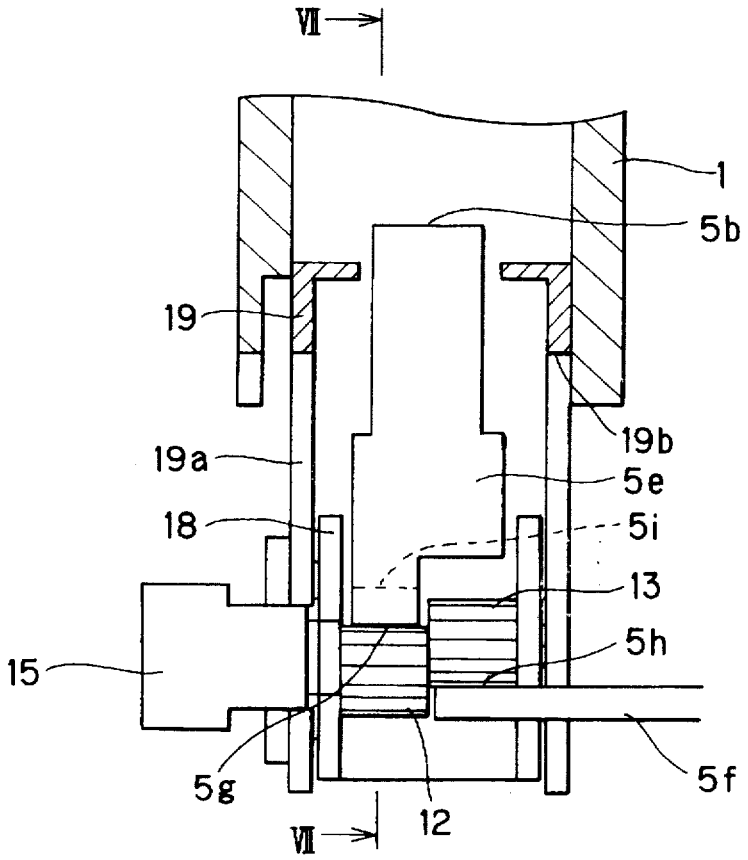
FIG. 6 is a cross-sectional view taken along the line VI—VI of FIG. 5.

As shown in FIG. 6, a guide member 19 having slots 19*a* and 19*b* is fixed to the main body 1. Within the guide member 19, a bearing member 18 is slidably movably disposed for rotatably supporting the cam shaft 14. The cam shaft 14 has one end provided with a knob 15 disposed outside the guide member 19 and movable in the slot 19*a*. The upper section 5*e* of the push lever 5 has a lowermost end 5*g* slidingly engageable with the first cam lobe 12, while the lower section 5*f* has an uppermost end 5*h* slidingly engageable with the second cam lobe 13. The upper section 5*e*, an upper part of the lower section 5*f*, the cam lobes 12, 13 and the cam shaft 14 are covered by the guide member 19. The upper part of the lower section 5*f* extends through the slot 19*b* and into the bearing member 18.

Figure 7:
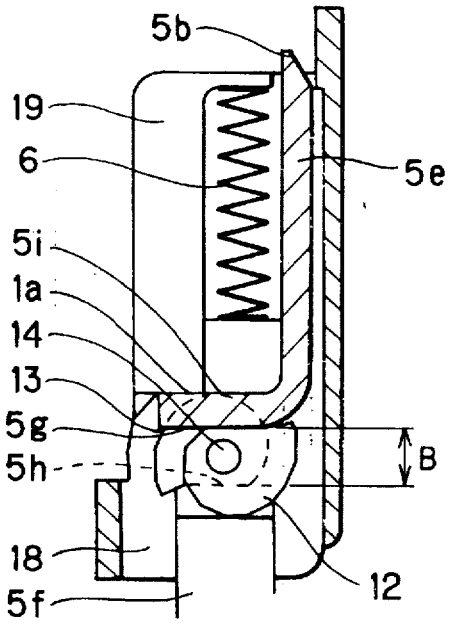
FIG. 7 is a cross-sectional view taken along the line VII—VII of FIG. 6.

In the guide member 19, a compression spring 6 is provided as shown in FIG. 7 so as to urge the entire push lever 5 downwardly. To this effect, the upper section 5*e* has a seat portion 5*i* on which one end of the compression spring 6 is seated. The guide member 19 integrally provides a stop piece 1*a* to which a portion of the upper section 5*e* is abuttable so as to prevent the upper section 5*e* from further moving upwardly. The lower section 5*f* is provided inseparable from the bearing member 18 but is movable with respect to the bearing member 18. Thus, the lower section 5*f*, the cam shaft 14 together with the cam lobes 12, 13, the upper section 5*e* and the bearing member 18 are movable concurrently within the guide member 19.

Figure 8:
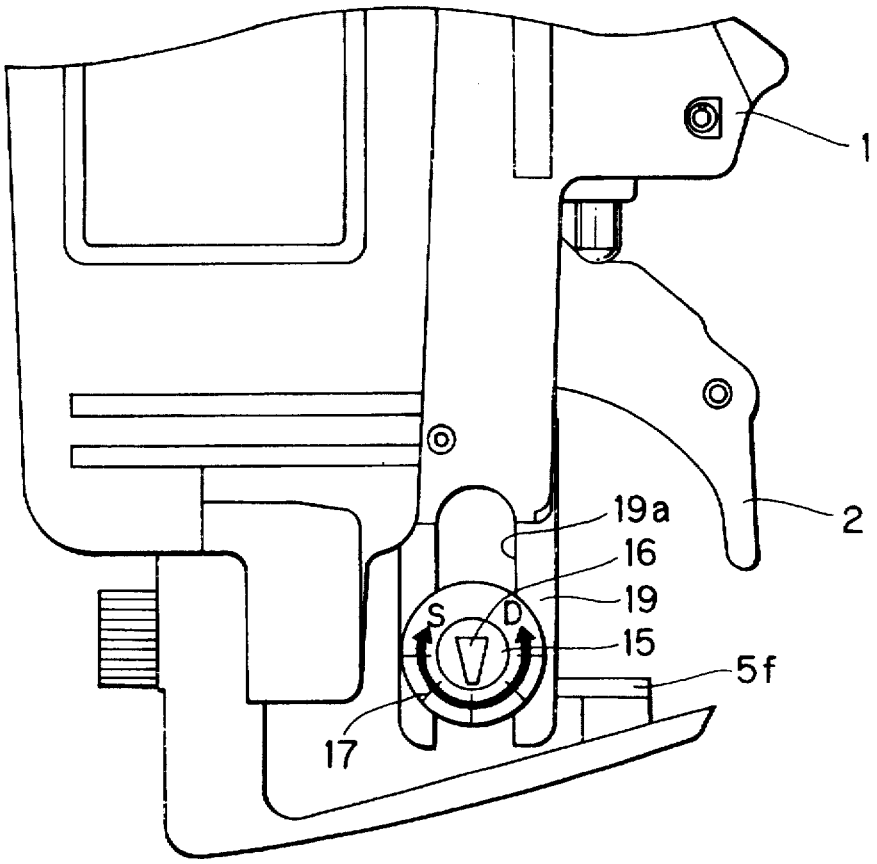
FIG. 8 is an enlarged side view showing the driving depth adjusting mechanism according to the first embodiment.

As best shown in FIG. 8, the knob 15 is provided with an indication mark 16, and around the knob 15 a scale plate 17 is provided so as to indicate a rotation angle of the knob 15, i. e., angular orientation of the cam lobes 12, 13. The scale 17 is advantageous for recognizing change in the driving depth or actual driving depth.

Figure 9:
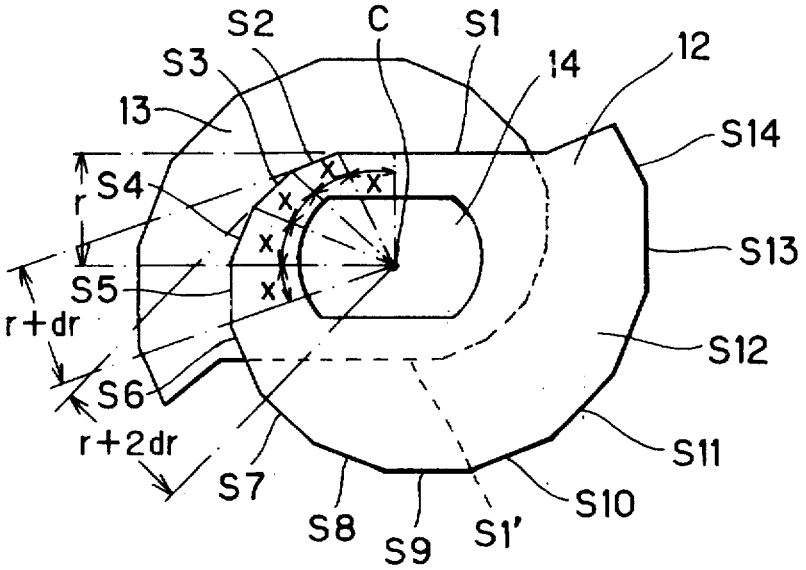
FIG. 9 is a view for description of first and second cam lobes used in the driving depth adjusting mechanism according to the first embodiment.

Configuration of the cam lobes 12, 13 is shown in FIG. 9. As described above, the contour of the cam lobes 12, 13 is identical with each other but their angular orientation is displaced by 180 degrees. The cam surface of the first cam lobe 12 is provided by a plurality of planes S1, S2, . . . , S14, each being provided in correspondence with a constant rotation angle X with respect to the rotation axis C of the cam shaft 14. A distance (or a radius of the cam lobe) between the rotation axis C and the first surface S1 is "r", and a distance between the rotation axis C and the second surface S2 is "r+dr". The distance is increased by "dr" in accordance with the increase in rotation angle by "X". For example, a distance between the rotation axis C and a fifth cam surface S5 is "r+4 dr". The same is true with respect to the second cam lobe 13.

With this arrangement, if the lowermost end 5*a* of the lower section 5*f* of the push lever 5 is depressed against a workpiece 11 as shown in FIG. 5, the uppermost end 5*h* of the lower section 5*f* is brought into abutment with the second cam lobe 13 and pushes the second cam lobe 13 upwardly. Since the second cam lobe 13 is provided integrally with the cam shaft 14 and the first cam lobe 12, the cam shaft 14 and the bearing member 18 are moved upwardly. Therefore, the upper section 5*e* is also moved upwardly against the biasing force of the compression spring 6 because of the upward movement of the first cam lobe 12. This upward movement is stopped when the upper section 5*e* abuts the stop piece 1*a*. Incidentally, upward movement of the lower section 5*f*, the cam shaft 14 together with the cam lobes 12, 13 and the upper section 5*e* are smoothly guided by the guide member 19. Similar to the conventional arrangement, if the trigger 2 is pulled in this state, the fastener 4 can be driven into the workpiece 11 by the downward movement of the piston and the drive bit 7.

On the other hand, if the lowermost end 5*a* of the lower section 5*f* is separated from the workpiece 11, the lower section 5*f*, the cam shaft 14 together with the cam lobes 12, 13, and the upper section 5*e* are urged downwardly by the biasing force of the compression spring 6. This downward movement is also guided by the guide member 19. In this state, even if the trigger 2 is pulled, the drive bit 7 is not moved downwardly as described above.

Figure 10A:
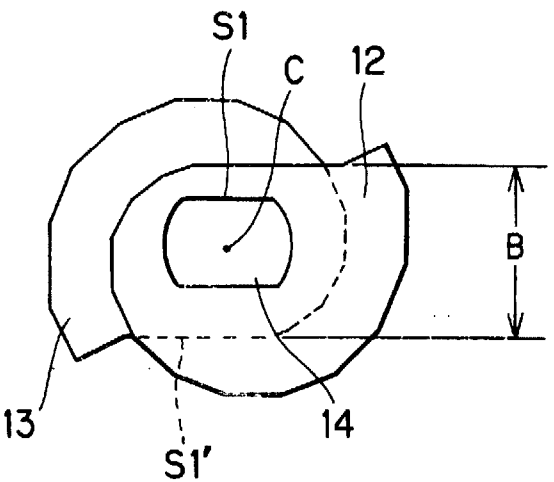
FIG. 10(*a*) is a view for description of the smallest distance between upper and lower sections of a push lever in accordance with a home position of the first and second cam lobes according to the first embodiment.
Figure 10B:
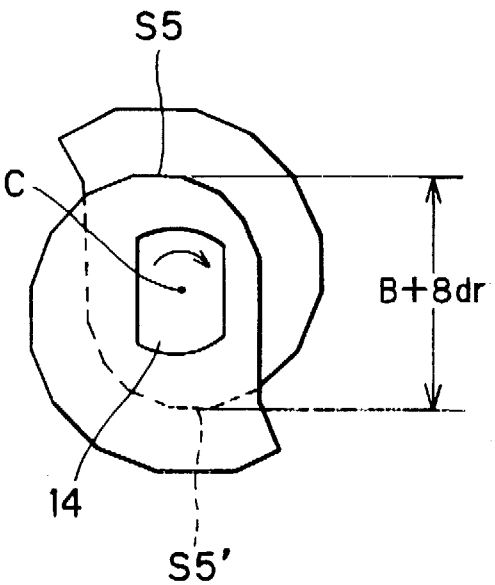
Figure 10C:
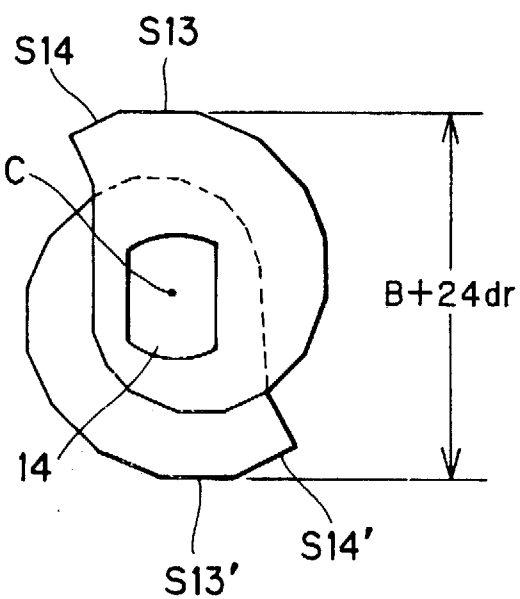
Figure 11A:
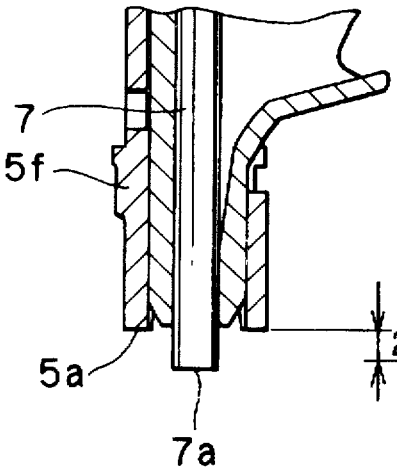
FIG. 11(*a*) is a partial cross-sectional view showing tip end portions of a drive bit and the push lever in a state shown in FIGS. 7 and 10(*a*)
Figure 11B:
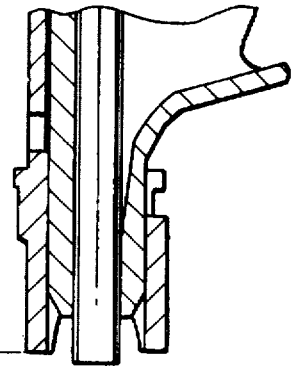

For adjusting the driving depth, if the indication mark 16 of the knob 15 is rotationally aligned with "D" scale in the scale plate 17, a state shown in FIGS. 7 and 10(*a*) is provided in which the lowermost end 5*g* of the upper section 5*e* of the push lever 5 is rested on the cam surface S1 of the first cam lobe 12, and the uppermost end 5*h* of the lower section 5*f* of the push lever 5 is in contact with the cam surface S1' of the second cam lobe 13. In this state, a distance between the lowermost end 5*g* of the upper section 5*e* and the uppermost end 5*h* of the lower section 5*f* is the smallest distance B. Accordingly, entire length of the push lever 5 is the smallest, so that a distance between the lowermost end 5*a* of the push lever 5 and the lowermost end 7*a* of the drive bit 7 becomes the largest. This implies that deep driving can be performed as shown in FIG. 11(*a*).

If the knob 15 is rotated in a clockwise direction in FIGS. 7, 9, and 10(*a*), the first and second cam lobes 12, 13 are also rotated in the direction. Therefore, if the knob 15 is rotated by the angle "X", the lowermost end 5*g* of the upper section 5*e* is brought into contact with the cam surface S2 of the first cam lobe 12, and the uppermost end 5*h* of the lower section 5*f* of the push lever 5 is brought into contact with the cam surface S2' of the second cam lobe 13. Accordingly, radius of the first cam 12 is changed from r to r+dr, and radius of the second cam 13 is also changed from r to r+dr. Accordingly, the distance between the lowermost end 5*g* of the upper section 5*e* and the uppermost end 5*h* of the lower section 5*f* is increased to B+2 dr. In other words, increasing amount can be doubled, because of the employment of the two cam lobes 12, 13. Consequently, an entire length of the push lever 5 is increased by 2 dr, and therefore, a distance between the lowermost end 5*a* of the push lever 5 and the lowermost end 7*a* of the drive bit 7 is decreased. This implies that the nail driving depth is reduced.

As shown in FIG. 9, a radius of the cam surface is increased by "dr" in accordance with the increase in the rotation angle of the cam lobe by "X", and because two cam lobes 12, 13 are provided, the increasing amount of the distance between the ends 5*g* and 5*h* can be doubled.

Similarly, if the knob 15 is rotated by about 90 degrees in the clockwise direction, a state shown in FIG. 10(*b*) is provided in which the lowermost end 5*g* of the upper section 5*e* is in contact with the cam surface S5 of the first cam lobe 12, and the uppermost end 5*h* of the lower section 5*f* of the push lever 5 is in contact with the cam surface S5' of the second cam lobe 13. In this state, a distance between the lowermost end 5g of the upper section 5e and the uppermost end 5h of the lower section 5f becomes B+8 dr. That is, by rotation of the first cam lobe 12 by 90 degrees, a radius is increased by 4 dr. Concurrently, by this rotation, the second cam lobe 13 is also rotated, so that a radius is increased by 4 dr with respect to the second cam 13 also. Because two cam lobes 12, 13 contributes the increase in the distance, the resultant increasing amount is 8 dr.

Similarly, if the knob 15 is rotated by about 270 degrees, i.e., if the indication mark 16 is aligned with near the S of the scale plate 17, a state shown in FIG. 10(*c*) is provided. In this case, the plane S13 and S13' are in contact with the lowermost end 5g and the uppermost end 5h, respectively, and the distance between the lowermost end 5g and the uppermost end 5h becomes B+24 dr. In this case, resultant length of the push lever 5 becomes the second greatest. Incidentally, if the knob 15 is rotated by about 290 degrees, i.e., if the indication mark 16 is completely aligned with the S of the scale plate 17, the distance between the lowermost end 5g and the uppermost end 5h becomes B+26 dr. In this case, resultant length of the push lever 5 becomes the greatest where the plane S14 and S14' are in contact with the respective ends 5g and 5h.

In view of the foregoing, according to the first embodiment of the present invention, because two cam lobes 12 and 13 are used, expansion or shrinking amount of the entire push lever 5 can be doubled in comparison with a case where only a single cam lobe is used, and it is unnecessary to use large size cam lobe. Therefore, the driving depth adjusting mechanism of this embodiment can provide a compact size capable of installing in a small area, such as adjacent the trigger 2. Furthermore, only a limited angular rotation of the knob 15 can provide high rate expansion and shrinkage of the push lever 5. In other words, it is unnecessary to rotate the knob 15 several times, i.e., by more than 360 degrees, which in turn enhances operability. Furthermore, since the lowermost end 5g of the upper section 5e and the uppermost end 5h of the lower section 5f are in plane contact with one of the plane cam surfaces, frictional wearing at the contacting area can be reduced, so that driving depth adjustment can be performed precisely in comparison with a case where an arcuate cam surface is in point or line contact with such the lowermost and uppermost ends 5g, 5h.

A pneumatic nailing machine having a depth adjustment mechanism according to a second embodiment of the present invention will be described with reference to FIG. 12. In the second embodiment, a pair of second cam lobes 13', 13' are provided for contacting with an uppermost end 5h' of the lower section 5f'. The pair of second cam lobes 13', 13' interpose therebetween the first cam lobe 12' in a symmetrical fashion in a guide plate 19'.

The second embodiment is the improvement on the first embodiment in that, in the first embodiment, couple of forces may be generated. That is, as shown in FIG. 6, the second cam lobe 13 is imparted with an upwardly directing force from the lower section 5f during driving operation, and the first cam lobe 12 is imparted with downward reaction force from the upper section 5e, even though entire push lever 5 is moved upwardly for nail driving operation. Thus, points of force applications are not linearly arranged but offset from each other. Accordingly, the cam shaft 14 may be urged to be pivoted in a counterclockwise direction in FIG. 6. This may cause inclination of the bearing member 18 within the guide member 19, which may degrade vertical movement of the entire push lever 5.

In the second embodiment, since the pair of second cam lobes 13',13' are arranged symmetrically with respect to the first cam lobe 12', the above described couple of forces are not generated. Accordingly, smooth vertical movement of the push lever can be provided. Further, in the second embodiment, the bearing member 18 used in the first embodiment is not provided. Instead, as shown in FIG. 12, a pair of side plates 5e1, 5e2 integrally extend downwardly from the lower end of the upper section 5e' so as to reduce number of mechanical parts. The pair of side plates 5e1, 5e2 are disposed to interpose therebetween a downwardly protruding portion 5e3 whose lowermost surface defines the lowermost end 5g' engageable with the first cam lobe 12'.

Outer surfaces of the side plates 5e1, 5e2 are slidably supported by the guide member 19', and each inner surface of the side plate 5e1, 5e2 is in slidable contact with each outer side face of the second cam lobe 13' and outer surface of the lower section 5f'. Further, the side plates 5e1, 5e2 rotatably support a cam shaft 14'.

Figure 12:
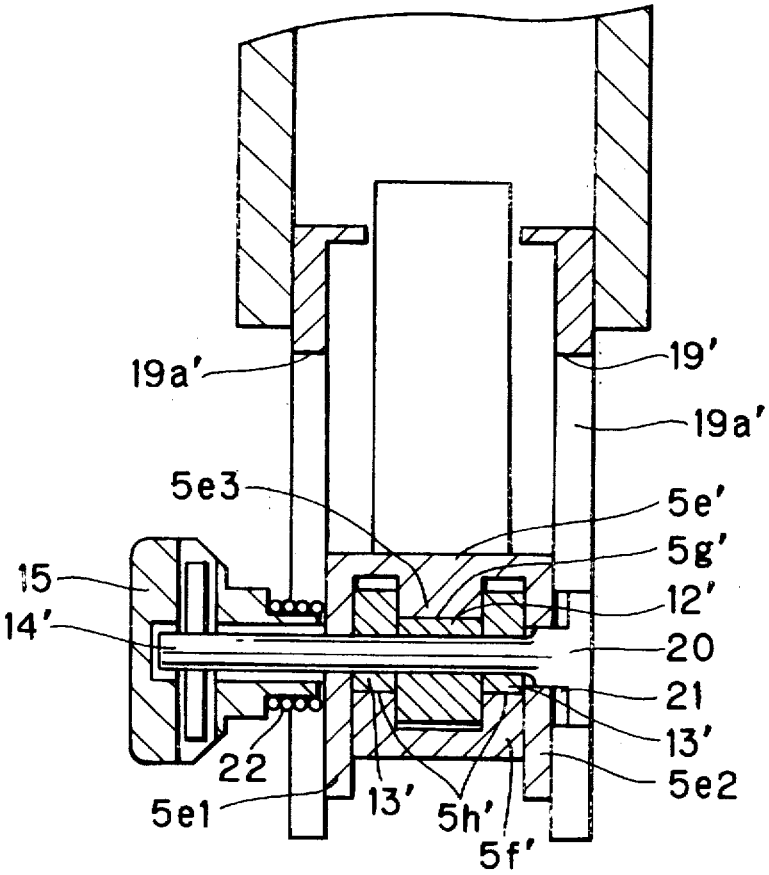

At one end portion of the cam shaft 14', the knob 15 is fixedly secured, and a compression spring 22 is interposed between the knob 15 and the outer surface of the one side plate 5e1 so as to urge the cam shaft 14' leftwardly in FIG. 12. The cam shaft 14' has another end portion provided with a head portion 20 to which at least one projection (not shown) projecting toward the other side plate 5e2 is provided. On the other hand, at the outer surface of the other side plate 5e2, a latch member 21 is fixed. The latch member 21 is formed with a plurality of grooves (not shown) arranged radially and spaced away from each other in a rotational angle by "X". The projection of the head portion 20 is engageable selectively with one of the grooves so as to temporarily fix the angular rotational position of the cam shaft 14'. The compression spring 22 ensures the engagement of the projection with one of the grooves.

While the invention has been described in detail and with reference to the specific embodiments thereof, it would be apparent to those skilled in the art that various changes and modifications may be made therein without departing from the spirit and scope of the invention. For example, in the depicted embodiment, the first and second cam lobes 12,13 have identical configuration. However, contour of the second cam lobe 13 can be different from that of the first cam lobe 12 as far as a necessary driving depth can be provided and rotation of the knob can indicate driving depth. Further, in the illustrated embodiment, the cam lobes are provided integrally with each other and these cam lobes are provided integrally with the cam shaft so as to facilitate assembly. However, these components can be provided separately and can be connected together.

What is claimed is:

1. A pneumatic nailing machine for driving a nail into a workpiece, the pneumatic nailing machine comprising:

a main body;

a nose provided to the main body, the nail being protrudable from the nose;

a trigger pivotally supported to the main body for starting a nail driving operation;

a push lever vertically movably supported to the main body, the push lever having a lower tip portion positioned near the nose and an upper tip portion positioned near the trigger, the push lever being divided into an upper section having a lowermost end and a lower section having an uppermost end;

a drive bit supported in the main body and movable in an axial direction thereof, the drive bit being moved along the nose upon manipulation of the trigger; and a nail driving depth adjusting mechanism for controlling a distance between a lower tip end of the nose and a lower tip end of the push lever when the push lever is pressed against the workpiece, the nail driving depth adjusting mechanism comprising:

a shaft portion rotatable about its axis, the shaft portion being positioned adjacent the trigger;

a knob portion connected to the shaft portion for rotating the shaft portion about its axis;

a first cam lobe provided to the shaft portion and having a first cam surface engageable with the lowermost end of the upper section; and a second cam lobe provided to the shaft portion and having a second cam surface engageable with the uppermost end of the lower section, contour of the first and second cam surfaces being arranged to simultaneously move the lowermost end and the uppermost end away from each other in accordance with a rotation of the knob in one direction and to simultaneously move the lowermost end and the uppermost end toward each other in accordance with the rotation of the knob in an opposite direction.

2. The pneumatic nailing machine as claimed in claim 1, wherein the first cam lobe and the second cam lobe are provided integrally.

3. The pneumatic nailing machine as claimed in claim 1, wherein the first cam surface has a plurality of first flat planes, and the lowermost end of the upper section has a flat surface in surface engagement with one of the first flat planes, and wherein the second cam surface has a plurality of second flat planes, and the uppermost end of the lower section has a flat surface in surface engagement with one of the second flat planes.

4. The pneumatic nailing machine as claimed in claim 3, wherein the plurality of the first flat planes are provided at equal angular intervals of the first cam lobe, and wherein the plurality of the second planes are provided at equal angular intervals of the second cam lobe.

5. The pneumatic nailing machine as claimed in claim 4, wherein a radius of the first cam lobe is increased by a constant ratio in accordance with the increase in angular rotation of the cam shaft, and wherein a radius of the second cam lobe is also increased by a constant ratio in accordance with the increase in angular rotation of the cam shaft.

6. The pneumatic nailing machine as claimed in claim 5, wherein the first and second cam lobes are provided in a rotation-symmetric fashion in which a symmetry center is at the axis of the shaft portion and the first and second cam lobes are provided at an angular displacement of 180 degrees with respect to the axis so that rotating the shaft portion by 180 degrees about the symmetry center can align one of the cam lobes in the same direction as the other cam lobe.

7. The pneumatic nailing machine as claimed in claim 5, wherein the second cam lobe comprises a pair of cam lobes oriented in the same direction, the first cam lobe being interposed between the pair of cam lobes.

8. The pneumatic nailing machine as claimed in claim 1, further comprising a guide member fixed to the main body for housing therein a part of the upper section, a part of the lower section, the shaft portion and the cam lobes, vertical movement of the upper and lower sections, the shaft portion and the cam lobes being guided by the guide member when the lower tip end of the push lever is pressed against the workpiece, the guide member having a stop piece to which a part of the upper section is abuttable for preventing the upper section from being further moved upwardly.

9. The pneumatic nailing machine as claimed in claim 8, further comprising a compression spring supported in the guide member for urging the upper section downwardly.

10. The pneumatic nailing machine as claimed in claim 9, wherein the first cam lobe and the second cam lobe are provided integrally.

11. The pneumatic nailing machine as claimed in claim 10, wherein the first cam surface has a plurality of first flat planes, and the lowermost end of the upper section has a flat surface in surface engagement with one of the first flat planes, and wherein the second cam surface has a plurality of second flat planes, and the uppermost end of the lower section has a flat surface in surface engagement with one of the second flat planes.

12. The pneumatic nailing machine as claimed in claim 11, wherein the plurality of the first flat planes are provided at equal angular intervals of the first cam lobe, and wherein the plurality of the second planes are provided at equal angular intervals of the second cam lobe.

13. The pneumatic nailing machine as claimed in claim 12, wherein a radius of the first cam lobe is increased by a constant ratio in accordance with the increase in angular rotation of the cam shaft, and wherein a radius of the second cam lobe is also increased by a constant ratio in accordance with the increase in angular rotation of the cam shaft.

14. The pneumatic nailing machine as claimed in claim 13, wherein the first and second cam lobes are provided in a rotation-symmetric fashion in which a symmetry center is at the axis of the shaft portion and the first and second cam lobes are provided at an angular displacement of 180 degrees with respect to the axis so that rotating the shaft portion by 180 degrees about the symmetry center can align one of the cam lobes in the same direction as the other cam lobe.

15. The pneumatic nailing machine as claimed in claim 13, wherein the second cam lobe comprises a pair of cam lobes oriented in the same direction, the first cam lobe being interposed between the pair of cam lobes.

* * * * *